United States Patent [19]

Maglica

[11] Patent Number: 4,899,265

[45] **Date of Patent: * Feb. 6, 1990**

[54] MINIATURE FLASHLIGHT

[75] Inventor: Anthony Maglica, Ontario, Calif.

[73] Assignee: Mag Instrument, Inc., Ontario, Calif.

[ * ] Notice: The portion of the term of this patent subsequent to Aug. 18, 2003 has been disclaimed.

[21] Appl. No.: 222,378

[22] Filed: Jul. 19, 1988

Related U.S. Application Data

[63] Continuation of Ser. No. 34,918, Apr. 6, 1987, abandoned, which is a continuation of Ser. No. 828,729, Feb. 11, 1986, Pat. No. 4,658,336, which is a continuation of Ser. No. 648,032, Sep. 6, 1984, Pat. No. 4,577,263.

[51] Int. Cl.[4] ..... F21L 7/00

[52] U.S. Cl. ..... 362/187; 362/203; 362/205

[58] Field of Search ..... 362/187, 201, 202, 203, 362/205, 207, 208, 197

[56] References Cited

U.S. PATENT DOCUMENTS

| | | | |
|---|---|---|---|
| 1,584,539 | 11/1926 | Hopkins . | |
| 1,680,169 | 10/1928 | Osean | 362/188 |
| 2,016,819 | 7/1935 | Meginniss | 362/188 |
| 2,097,222 | 4/1937 | Tompkins et al. | 340/10.06 |
| 2,176,301 | 10/1939 | Haas | 123/187 |
| 2,339,356 | 8/1941 | Sachs | 240/10.69 |
| 2,490,830 | 9/1949 | Norton | 362/205 |
| 2,530,913 | 11/1950 | Shackel | 123/187 |
| 2,599,295 | 9/1952 | Thomas | 362/205 |
| 2,915,621 | 2/1959 | Garland | 362/205 |
| 2,931,005 | 7/1960 | Saurwein . | |
| 2,945,944 | 6/1960 | Gillespie | 362/188 |
| 3,076,891 | 2/1963 | Moore | 362/202 |
| 4,203,150 | 10/1980 | Shamlian | 362/183 |

(List continued on next page.)

FOREIGN PATENT DOCUMENTS

| | | |
|---|---|---|
| 138873 | 2/1948 | Australia . |
| 2372382 | 7/1976 | France . |
| 411218 | 3/1934 | United Kingdom . |

OTHER PUBLICATIONS

Mag Instrument, Inc. Brochure, "Exhibit B", Illustrating Flashlight of Maglica Patent 4,286,311.

*Primary Examiner*—Ira S. Lazarus
*Assistant Examiner*—Peggy H. Neils
*Attorney, Agent, or Firm*—Lyon & Lyon

[57] ABSTRACT

A miniature flashlight as disclosed to comprise a barrel, a tail cap, a head assembly, and means for holding a miniature lamp bulb and for providing interruptible electrical coupling to dry cell batteries retained within the barrel. The means for holding lamp bulb comprises an insulated receptacle disposed external to the end of the barrel to which the head assembly is engaged, a second insulated receptacle disposed within the barrel and matingly engaging with the first insulated receptacle so as to enable the first and second insulated receptacles to translate axially through a distance limited by a flange formed on the first insulated receptacle and an annular lip formed inwardly at the end of the barrel, and a pair of conductor members mounted in the second insulated receptacle such that one of the conductors serves to couple the center electrode of a dry cell battery to a first pin of the lamp bulb and the other conductor member serves to electrically couple the second pin of the lamp bulb to the lip formed on the barrel. A spring is disposed between the tail cap and the batteries within the barrel to urge the batteries into contact with the center conductor on the second insulated receptacle, thereby urging the second and the first insulated receptacles in the same direction until the second insulated receptacle contacts the lip on the end of the barrel whereat the second conductor member is in contact with the lip. The electrical circuit is thus closed by use of the barrel, the tail cap, and the spring to couple the second pin of the lamp to the case terminal of the battery. By threadably engaging the head assembly onto the barrel in a direction causing the head assembly to translate along the barrel towards the tail cap, the reflector moves with respect to the lamp bulb to cause a variation in dispersion of the reflected light beam emanating from the lamp bulb.

13 Claims, 2 Drawing Sheets

U.S. PATENT DOCUMENTS

| | | | |
|---|---|---|---|
| 4,234,913 | 1/1980 | Ramme | 362/158 |
| 4,261,026 | 3/1981 | Bolha | 362/101 |
| 4,286,311 | 3/1981 | Maglica | 362/205 |
| 4,329,740 | 7/1982 | Colvin | 362/184 |
| 4,388,673 | 4/1983 | Maglica | 362/183 |
| 4,398,232 | 4/1983 | Nelson | 362/187 |
| 4,429,351 | 4/1984 | Petzl et al. | 362/187 |
| 4,472,766 | 11/1984 | Hung | 364/158 |
| 4,531,178 | 7/1985 | Uke | 362/202 X |
| 4,577,263 | 6/1986 | Maglica | 362/188 |
| 4,658,336 | 4/1987 | Maglica | 362/187 X |
| 4,695,551 | 3/1988 | Foltz | 362/205 |
| 4,777,582 | 10/1988 | Sharrah | 362/202 X |

36
21
31
49
24
48
38
39
41
23
42
46
47
53
52
25
25'
26
51
51'
45
26'
A
A 28
22
33
32
62
34
35
21
31
37
20
49
23
24
48
38
39
41
42
46
47
43
44
53
52
25
51
45
26

2
28
22
30
20
27
21
24
25
23
26
2

MINIATURE FLASHLIGHT

This is a continuation of application Ser. No. 034,918, filed Apr. 6, 1987, now abandoned, which is a continuation of application Ser. No. 828,729, filed Feb. 11, 1986, now U.S. Pat. No. 4,658,336, which is a continuation of application Ser. No. 648,032, filed Sept. 6, 1984, now U.S. Pat. No. 4,577,263.

BACKGROUND OF THE INVENTION

1. Field of the Invention

The present invention relates primarily to flashlights, and in particular, to a miniature handheld flashlight.

2. Discussion of the Prior Art

Flashlights of varying sizes and shapes are well-known in the art. In particular, certain of such known flashlights utilize two or more dry cell batteries, carried in series in a cylindrical tube serving as a handle for the flashlight, as their source of electrical energy. Typically, an electrical circuit is established from one electrode of the battery through a conductor to a switch, then through a conductor to one electrode of the lamp bulb. After passing through the filament of the lamp bulb, the electrical circuit emerges through a second electrode of the lamp bulb in electrical contact with a conductor, which in turn is in electrical contact with the flashlight housing. The flashlight housing provides an electrical conduction path to an electrical conductor, generally a spring element, in contact with the other electrode of the battery. Actuation of the switch to complete the electrical circuit enables electrical current to pass through the filament, thereby generating light which is typically focused by a reflector to form a beam of light.

The production of light from such flashlights has often been degraded by the quality of the reflector utilized and the optical characteristics of any lens interposed in the beam path. Moreover, intense light beams have often required the incorporation of as many as seven dry cell batteries in series, thus resulting in a flashlight having significant size and weight.

Efforts at improving such flashlights have primarily addressed the quality of the optical characteristics. The production of more highly reflective, well-defined reflectors, which may be incorporated within such flashlight, have been found to provide a more well-defined focus thereby enhancing the quality of the light beam produced. Additionally, several advances have been achieved in the light admitting characteristics of flashlight lamp bulbs.

Since there exists a wide variety of uses for hand-held flashlights, the development of the flashlight having a variable focus, which produces a beam of light having a variable dispersion, has been accomplished. However, such advances have heretofore been directed at "full-sized" flashlights.

SUMMARY OF THE INVENTION

It is a primary object of the present invention to provide a miniature hand-held flashlight having improved optical characteristics.

It is another object of the present invention to provide a miniature hand-held flashlight which is capable of producing a beam of light having a variable dispersion.

It is a further object of the present invention to provide a miniature hand-held flashlight which is capable of supporting itself vertically on a horizon surface to serve as an "ambient" unfocused light source.

It is another object of the present invention to provide a miniature hand-held flashlight wherein relative motions of components that produce the variation and the dispersion of the light beam provide an electrical switch function to open and complete the electrical circuit of the flashlight.

These and other objects of the present invention, which may become obvious to those skilled in the art through the hereinafter detailed description of the invention are achieved by a miniature flashlight comprising: a cylindrical tube containing at least two miniature dry cell batteries disposed in a series arrangement, a lamp bulb holder assembly including electrical conductors for making electrical contact between terminals of a miniature lamp held therein and the cylindrical tube and an electrode of the battery, respectively, retained in one end of the cylindrical tube adjacent the batteries, a tail cap and spring member enclosing the other end of the cylindrical tube and providing an electrical contact to the other electrode of the batteries, and a head assembly including a reflector, a lens, and a face cap, which head assembly is rotatably mounted to the cylindrical tube such that the lamp bulb extends through a hole in the center of the reflector within the lens. In the principle embodiment of the present invention, the batteries are of the size commonly referred to as "pen light" batteries.

The head assembly engages threads formed on the exterior of the cylindrical tube such that rotation of a head assembly about the axis of the cylindrical tube will change the relative displacement between the lens and the lamp bulb. When the head assembly is fully rotated onto the cylindrical tube, the reflector pushes against the forward end of the lamp holder assembly causing it to shift rearward within the cylindrical tube against the urging of the spring contact at the tail cap. In this position, the electrical conductor within the lamp holder assembly which completes the electrical circuit from the lamp bulb to the cylindrical tube is not in contact with the tube. Upon rotation of the head assembly in a direction causing the head assembly to move forward with respect to the cylindrical tube, pressure on the forward surface of the lamp holder assembly from the reflector is relaxed enabling the spring contact in the tail cap to urge the batteries and the lamp holder assembly in a forward direction, which brings the electrical conductor into contact with the cylindrical tube, thereby completing the electrical circuit and causing the lamp bulb to illuminate. At this point, the lamp holder assembly engages a stop which prevents further forward motion of the lamp holder assembly with respect to the cylindrical tube. Continued rotation of the head assembly in a direction causing the head assembly to move forward relative to the cylindrical tube causes the reflector to move forward relative to the lamp bulb, thereby changing the focus of the reflector with respect to the lamp bulb, which results in varying the dispersion of the light beam admitted through the lens.

By rotating the head assembly until it disengages from the cylindrical tube, the head assembly may be placed, lens down, on a substantially horizontal surface and the tail cap and cylindrical tube may be vertically inserted therein to provide a miniature "table lamp".

DETAILED DESCRIPTION OF A PREFERRED EMBODIMENT

Figure 1:
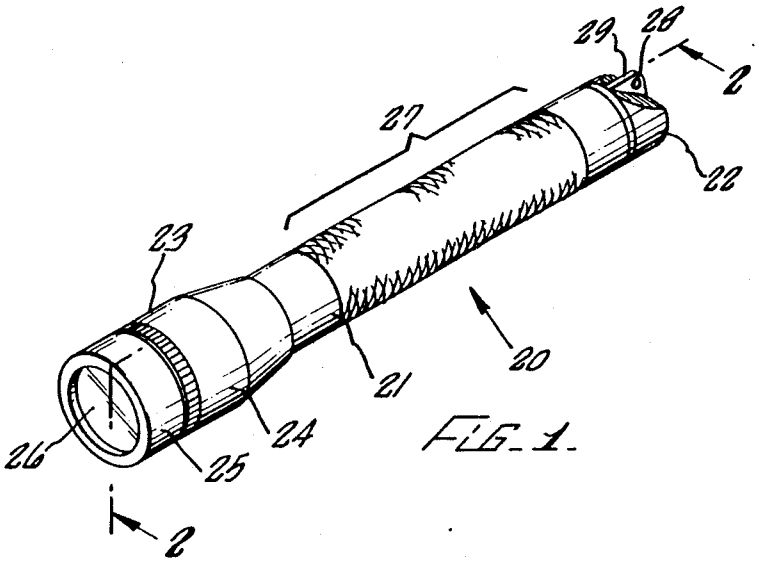
FIG. 1 is a perspective view of a miniature flashlight in accordance with the present invention.

Referring first to FIG. 1, a miniature flashlight in accordance with the present invention is illustrated in perspective generally at 20. The miniature flashlight 20 is comprised of a generally right circular cylinder, or barrel 21, enclosed at a first end by a tail cap 22 and having a head assembly 23 enclosing a second end thereof. The head assembly comprises a head 24 to which is affixed a face cap 25 which retains a lens 26. The head assembly 23 has a diameter greater than that of the barrel 21 and is adapted to pass externally over the exterior of the barrel 21. The barrel 21 may provide a machined handle surface 27 along its axial extent. The tail cap 22 may be configured to include provision for attaching a handling lanyard through a hole 28 in a tab 29 formed therein.

Figure 2:
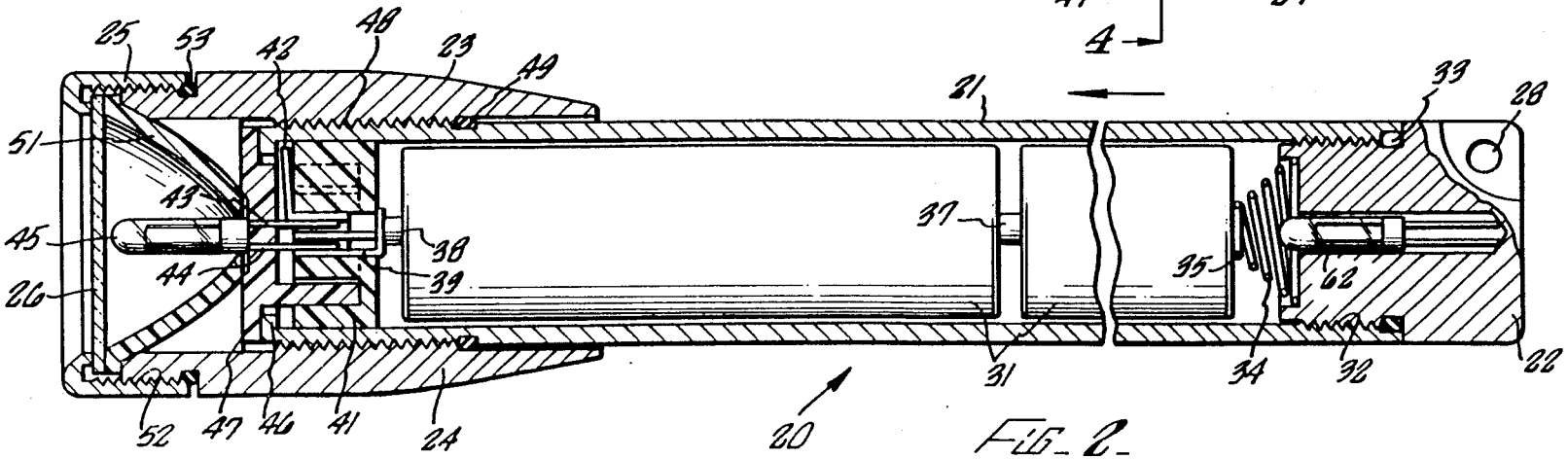
FIG. 2 is a partially foreshortened cross-sectional view of the miniature flashlight of FIG. 1 as taken through the plane indicated by 2—2.

Referring next to FIG. 2, the barrel 21 is seen to have an extent sufficient to enclose at least two miniature dry cell batteries 31 disposed in a series arrangement. The tail cap 22 has a region of external threading 32 which engages matching threads formed on the interior surface of the barrel 21. A sealing element 33, typically in the form of an O-ring, is provided at the interface between the tail cap 22 and the barrel 21 to provide a watertight seal. A spring member 34 is disposed within the barrel 21 so as to make electrical contact with the tail cap 22 and a case electrode 35 of an adjacent battery 31. The spring member 34 also urges the batteries 31 in a direction indicated by an arrow 36. A center electrode 37 of the rearmost battery 31 is in contact with the case electrode of the forward battery 31. The center electrode 38 of the forward battery is urged into contact with a first conductor 39 mounted within a lower insulator receptacle 41. The lower insulator receptacle 41 also has affixed therein a side contact conductor 42. Both the center conductor 39 and the side contact conductor 42 pass through holes formed in the lower insulator receptacle in an axial direction, and both are adapted to frictionally receive and retain the terminal electrodes 43 and 44 of a miniature bi-pin lamp bulb 45. Absent further assembly, the lower insulator receptacle is urged in the direction indicated by the arrow 36, by the action of the spring 34, to move until it comes into contact with a lip 46 formed on the end of the barrel 21. At that point electrical contact is made between the side contact conductor 42 and the lip 46 of the barrel 21.

An upper insulator receptacle 47 is disposed external to the end of the barrel 21 whereat the lower insulator receptacle 41 is installed. The upper insulator receptacle 47 has extensions that are configured to mate with the lower insulator receptacle 41 to maintain an appropriate spacing between opposing surfaces of the upper insulator receptacle 47 and the lower insulator receptacle 41. The lamp electrodes 43 and 44 of the lamp bulb pass through the upper insulator receptacle 47 and into electrical contact with the center conductor 39 and the side contact conductor 42, respectively, while the casing of the lamp bulb 45 rests against an outer surface of the upper insulator receptacle 47.

The head assembly 23 is installed external to the barrel 21 by engaging threads 48 formed on an interior surface of the head 24 engaging with matching threads formed on the exterior surface of the barrel 21. A sealing O-ring 49 is installed around the circumference of the barrel 21 adjacent the threads to provide a watertight seal between the head assembly 23 and the barrel 21. A substantially parabolic reflector 51 is configured to be disposed within the outermost end of the head 24, whereat it is rigidly held in place by the lens 26 which is in turn retained by the face cap 25 which is threadably engaged with threads 52 formed on the forward portion of the outer diameter of the head 24. An O-ring 53 may be incorporated at the interface between the face cap 25 and the head 24 to provide a water-tight seal.

When the head 24 is fully screwed onto the barrel 21 by means of the threads 48, the central portion of the reflector 51 surrounding a hole formed therein for passage of the lamp bulb 45, is forced against the outermost surface of the upper insulator receptacle 47, urging it in a direction counter to that indicated by the arrow 36. The upper insulator receptacle 47 then pushes the lower insulator receptacle 41 in the same direction, thereby providing a space between the forwardmost surface of the lower insulator receptacle 41 and the lip 46 on the forward end of the barrel 21. The side contact conductor 42 is thus separated from contact with the lip 46 on the barrel 21 as is shown in FIG. 2.

Figure 3:
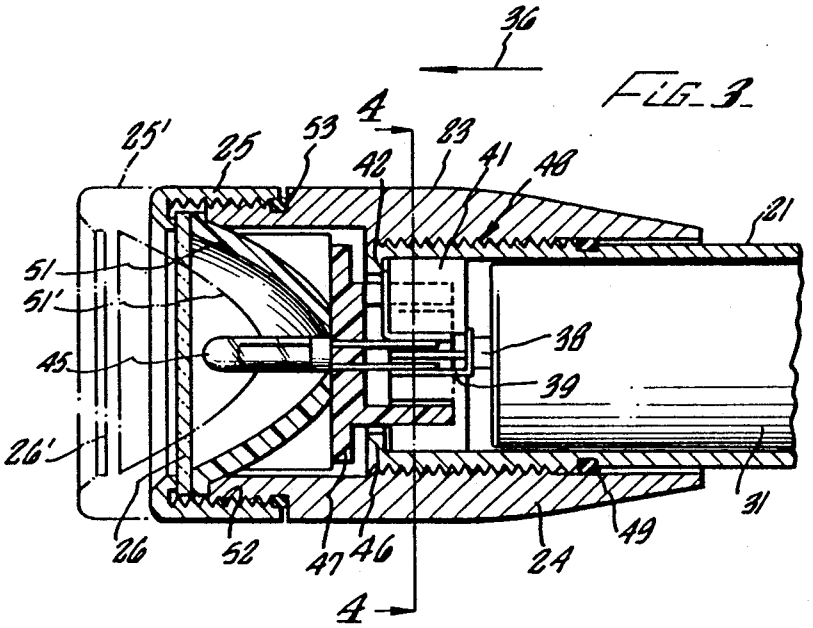
FIG. 3 is a partial cross-sectional view of a forward end of the miniature flashlight, illustrating, in ghost image, a translation of the forward end of the flashlight.

Referring next to FIG. 3, appropriate rotation of the head 24 about the axis of the barrel 21 causes the head assembly 23 to move in the direction indicated by the arrow 36 through the engagement of the threads 48. Upon reaching the relative positions indicated in FIG. 3 by the solid lines, the head assembly 23 has progressed a sufficient distance in the direction of the arrow 36 such that the reflector 51 has also moved a like distance, enabling the upper insulator receptacle 47 and the lower insulator receptacle 41 to be moved, by the urging of the spring 34 (FIG. 2) translating the batteries 31 in the direction of the arrow 36, to the illustrated position. In this position, the side contact conductor 42 has been brought into contact with the lip 46 on the forward end of the barrel 21, which closes the electrical circuit.

Further rotation of the head assembly 23 so as to cause further translation of the head assembly 23 in the direction indicated by the arrow 36 will result in the head assembly 23 reaching a position indicated by the ghost image of FIG. 3, placing the face cap at the position 25' and the lens at the position indicated by 26', which in turn carries the reflector 51 to a position 51'. During this operation, the upper insulator receptacle 47 remains in a fixed position relative to the barrel 21. Thus the lamp bulb 45 also remains in a fixed position. The shifting of the reflector 51 relative to the lamp bulb 45 during this additional rotation of the head assembly 23 produces a relative shift in the position of the filament of the lamp bulb 45 with respect to a focus of the parabola of the reflector 51, thereby varying the dispersion of the light beam emanating from the lamp bulb 45 through the lens 26.

Figures 4, 5, 6, 7, 8:
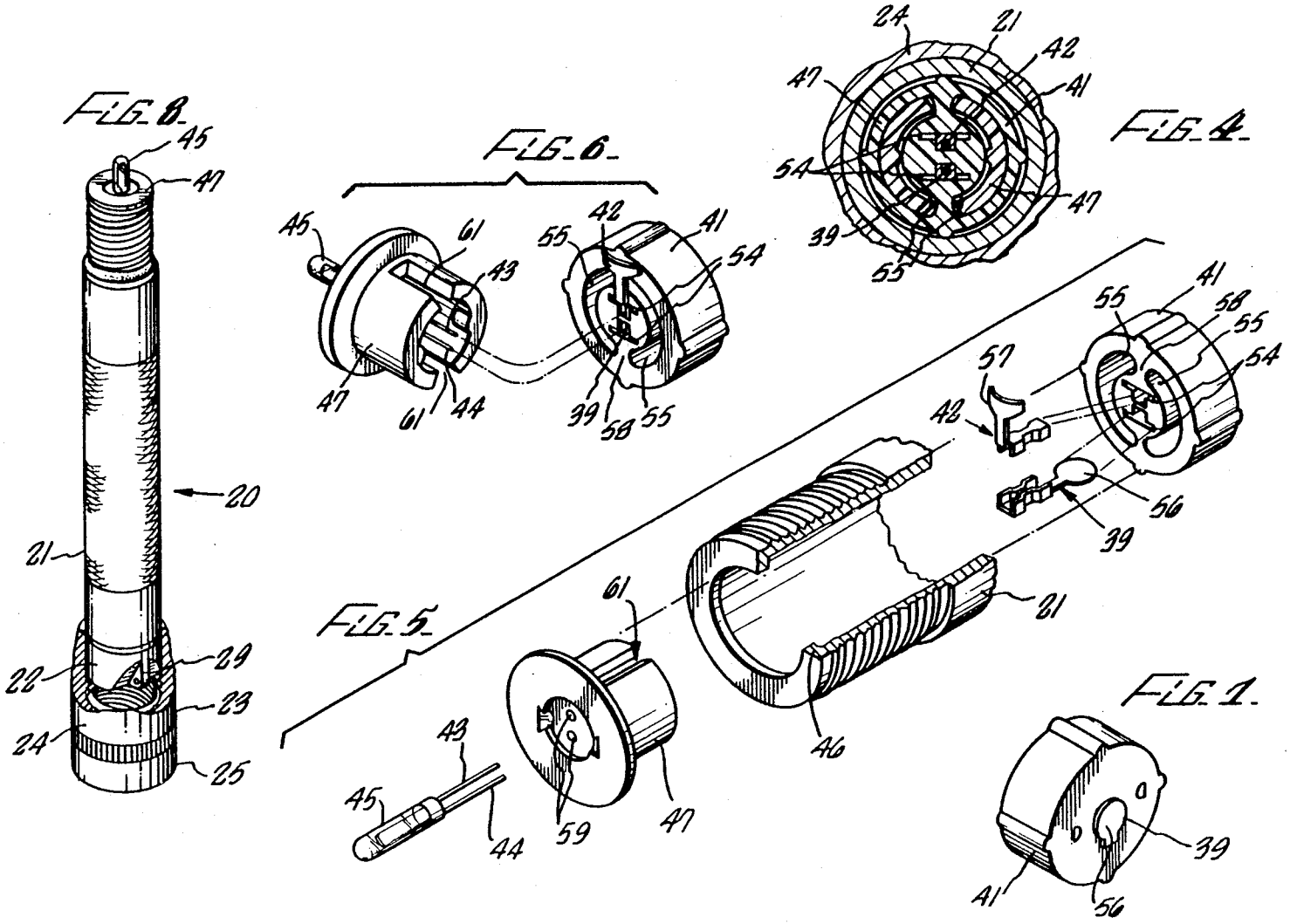
FIG. 4 is a partial cross-sectional view of a lamp bulb holder assembly used in accordance with the present invention, taken along the plane indicated by 4—4 of FIG. 3.
FIG. 5 is an exploded perspective view illustrating the assembly of the lamp bulb holder assembly with respect to a barrel of the miniature flashlight.
FIG. 6 is an isolated partial perspective view illustrating the electro mechanical interface between electrical terminals of the lamp bulb and electrical conductors within the lamp bulb holder.
FIG. 7 presents a perspective view of a rearward surface of the lamp bulb holder of FIG. 5, illustrating a battery electrode contact terminal.
FIG. 8 illustrates an alternate utilization of the miniature flashlight in accordance with the present invention.

Referring next to FIG. 4, a partial cross-sectional view illustrates the interface between the lower insulator receptacle 41 and the upper insulator receptacle 47. The lower insulator receptacle 41 has a pair of parallel slots 54 formed therethrough which are enlarged in their center portion to receive the center conductor 39 and the side contact conductor 42, respectively. A pair of arcuate recesses 55 are formed in the lower insulator receptacle 41 and receive matching arcuate extensions of the upper insulator receptacle 47. The lower insulator receptacle 41 is movably contained within the inner diameter of the barrel 21 which is in turn, at the location of the illustrated cross-section, enclosed within the head 24.

Referring next to FIGS. 5 through 7, a preferred procedure for the assembly of the lower insulator receptacle 41, the center conductor 39, the side contact conductor 42, the upper insulator receptacle 47 and the miniature lamp bulb 45 may be described. Placing the lower insulator receptacle 41 in a position such that the arcuate recesses 55 are directionally oriented towards the forward end of the barrel 21 and the lip 46, the center conductor 39 is inserted through one of the slots 54 such that a substantially circular end section 56 extends outwardly from the rear surface of the lower insulator receptacle 41. The circular end section 56 is then bent, as shown in FIG. 7, to be parallel with the rearmost surface of the lower insulator receptacle 41 in a position centered to match the center electrode of the forwardmost one of the batteries 31 of FIG. 2. The side contact conductor 42 is then inserted into the other slot 54 such that a radial projection 57 extends outwardly from the axial center of the lower insulator receptacle 41. It is to be noted that the radial projection 57 aligns with a web 58 between the two arcuate recesses 55.

The lower insulator receptacle 41, with its assembled conductors, is then inserted in the rearward end of the barrel 21 and is slidably translated to a forward position immediately adjacent the lip 46. The lamp electrodes 43 and 44 are then passed through a pair of holes 59 formed through the forward surface of the upper insulator receptacle 47 so that they project outwardly from the rear surface thereof as illustrated in FIG. 6. The upper insulator receptacle 47, containing the lamp bulb 45, is then translated such that the lamp electrodes 43 and 44 align with receiving portions of the side contact conductor 42 and the center conductor 39, respectively. A pair of notches 61, formed in the upper insulator receptacle 47, are thus aligned with the webs 58 of the lower insulator receptacle 41. The upper insulator receptacle 47 is then inserted into the arcuate recesses 55 in the lower insulator receptacle 41 through the forward end of the barrel 21.

Referring again to FIGS. 2 and 3, the electrical circuit of the miniature flashlight in accordance with the present invention will now be described. Electrical energy is conducted from the rearmost battery 31 through its center contact 37 which is in contact with the case electrode of the forward battery 31. Electrical energy is then conducted from the forward battery 31 through its center electrode 38 to the center contact 39 which is coupled to the lamp electrode 44. After passing through the lamp bulb 45, the electrical energy emerges through the lamp electrode 43 which is coupled to the side contact conductor 42. When the head assembly 23 has been rotated about the threads 48 to the position illustrated in FIG. 2, the side contact conductor 42 does not contact the lip 46 of the barrel 21, thereby resulting in an open electrical circuit. However, when the head assembly 23 has been rotated about the threads 48 to the position illustrated by the solid lines of FIG. 3, the side contact conductor 42 is pressed against the lip 46 by the lower insulator receptacle 41 being urged in the direction of the arrow 36 by the spring 34 of FIG. 2. In this configuration, electrical energy may then flow from the side contact conductor 42 into the lip 46, through the barrel 21 and into the tail cap 22 of FIG. 2. The spring 34 electrically couples the tail cap 22 to the case electrode 35 of the rearmost battery 31. By rotating the head assembly 23 about the threads 48 such that the head assembly 23 moves in a direction counter to that indicated by the arrow 36, the head assembly 23 may be restored to the position illustrated in FIG. 2, thereby opening the electrical circuit and turning off the flashlight.

Referring next to FIG. 8, an additional utilization of the miniature flashlight 20 in accordance with the present invention is illustrated. By rotating the head assembly 23 about the threads 48 in a direction causing the head assembly 23 to translate relative to the barrel 21 in the direction of the arrow 36 of FIG. 3, the electrical circuit will be closed as previously described, and the lamp bulb 45 will be illuminated. Continued rotation of the head assembly 23 in that direction enables the head assembly 23 to be completely removed from the forward end of the miniature flashlight 20. By placing the head assembly 23 upon a substantially horizontal surface (not illustrated) such that the face cap 25 rests on the surface, the tail cap 22 of the miniature flashlight 20 may be inserted into the head 24 to hold the barrel 21 in a substantially vertical alignment. Since the reflector 51 (FIG. 2) is located within the head assembly 23, the lamp bulb 45 will omit a substantially spherical illumination, thereby providing a "ambient" light level.

In a preferred embodiment, the barrel 21, the tail cap 22, the head 24, and the face cap 25, forming all of the exterior metal surfaces of the miniature flashlight 20 are manufactured from aircraft quality, heat-treated aluminum, which is annodized for corrosion resistance. The sealing O-rings 33, 49, and 53 provide atmospheric sealing of the interior of the miniature flashlight 20 to a depth of 200 feet. All interior electrical contact surfaces are appropriately machined to provide efficient electrical conduction. The reflector 51 is a computer generated parabola which is vacuum aluminum metallized to ensure high precision optics. The threads 48 between the head 24 and the barrel 31 are machined such that revolution of the head assembly 23 through less than $\frac{1}{4}$ turn will close the electrical circuit, turning the flashlight on, and an additional $\frac{1}{4}$ turn will adjust the light beam from a "spot" to a "soft flood". A spare lamp bulb 62 may be provided in a cavity machined in the tail cap 22.

While I have described a preferred embodiment of the herein invention, numerous modifications, alterations, alternate embodiments, and alternate materials may be contemplated by those skilled in the art and may be utilized in accomplishing the present invention. It is envisioned that all such alternate embodiments are considered to be within the scope of the present invention as defined by the appended claims.

I claim:

1. A flashlight comprising:

a barrel for retaining at least one dry cell battery;

a lamp bulb having a filament;

bulb holding means positioned adjacent one end of the barrel and adapted to locate the bulb filament axially beyond the one end of the barrel;

a substantially parabolic reflector;

a substantially planar lens;

means for retaining the reflector and the lens being engageable with the barrel at the end of the bulb holding means is positioned and adapted to be controllably translatable along the barrel such that the relative positional relationship between the reflector and the lamp bulb may be varied, thereby varying a reflection dispersion of a light beam emanating through the lens from said lamp bulb;

means for electrically coupling a center electrode of one of the batteries to a first electrode of the lamp bulb; and means for electrically coupling a case electrode of one of the batteries to a second electrode of the lamp bulb;

wherein relative motion of the head means for retaining the reflector and the lens in an axial direction away from the barrel closes an electrical contact of one of the coupling means and further relative motion in said same axial direction separates said means for retaining the reflector and the lens from the barrel to expose the lamp bulb and thereby permits the dispersion of substantially spherical illumination.

2. A flashlight comprising:

a barrel for retaining in series a plurality of dry cell batteries;

a lamp bulb having a filament;

bulb holding means movably retained adjacent one end of the barrel and adapted to locate the bulb filament axially beyond the one end of the barrel;

a reflector;

a lens;

means for retaining the reflector and the lens being threadably mounted on the barrel at the end the bulb holding means is positioned, said means for retaining being adapted to be controllably translatable along the barrel upon rotation thereof with respect to the barrel;

means for electrically coupling a center electrode of one of the batteries to a first electrode of the lamp bulb; and means for electrically coupling a case electrode of one of the batteries to a second electrode of the lamp bulb;

wherein rotation of the means for retaining the reflector and the lens in an axial direction away from the barrel closes one of the means for electrically coupling and separates said means for retaining the reflector and the lens from the barrel to expose the lamp bulb and thereby permits the dispersion of substantially spherical illumination.

3. A flashlight comprising:

a barrel for retaining in series a plurality of dry cell batteries;

a bi-pin lamp bulb having a filament;

bulb holding means positioned adjacent one end of the barrel and adapted to locate the bulb filament axially beyond the one end of the barrel;

a substantially parabolic reflector;

a substantially planar lens;

means for retaining the reflector and the lens being engageable with the barrel at the end the bulb holding means is positioned and adapted to be controllably translatable along the barrel such that the relative positional relationship between the reflector and the bi-pin lamp bulb may be varied, thereby varying a reflection dispersion of a light beam emanating through the lens from said bi-pin lamp bulb;

means for electrically coupling a center electrode of one of the batteries to a first electrode of the bi-pin lamp bulb; and means for electrically coupling a case electrode of one of the batteries to a second electrode of the bi-pin lamp bulb;

wherein relative motion of the head means for retaining the reflector and the lens in an axial direction away from the barrel separates said means for retaining the reflector and the lens from the barrel to expose the bi-pin lamb bulb and thereby permits the dispersion of substantially spherical illumination; and wherein the head means for retaining the reflector and the lens is adapted to receive a tail cap and the barrel for use of the flashlight as a table lamp.

4. A flashlight comprising:

a barrel for retaining in series a plurality of dry cell batteries;

a lamp bulb having a filament;

bulb holding means positioned adjacent one end of the barrel and adapted to locate the bulb filament axially beyond the one end of the barrel;

a reflector;

a substantially planar lens;

means for retaining the reflector and the lens being engageable with the barrel at the end the bulb holding means is positioned and adapted to be controllably translatable along the barrel such that the relative positional relationship between the reflector and the lamp bulb may be varied, thereby varying a reflection dispersion of a light beam emanating through the lens from said lamp bulb;

means for electrically coupling a center electrode of one of the batteries to a first electrode of the lamp bulb; and means for electrically coupling a case electrode of one of the batteries to a second electrode of the lamp bulb;

wherein relative motion of the head means for retaining the reflector and the lens in an axial direction away from the barrel closes an electrical contact of one of the coupling means and further relative motion in said same axial direction separates said means for retaining the reflector and the lens from the barrel to expose the lamp bulb and thereby permits the dispersion of substantially spherical illumination.

5. A flashlight comprising:

a barrel for retaining at least one dry cell battery;

a lamp bulb having a filament;

a substantially parabolic reflector;

a substantially planar lens;

head means threadably mounted on the barrel and for retaining the reflector and the lens and adapted to be controllably translatable along the barrel upon rotation thereof with respect to the barrel such that the relative positional relationship between the reflector and the lamp bulb may be varied, thereby varying a reflection dispersion of a light beam emanating through the lens form said lamp bulb;

coupling means movably retained by one end of the barrel and for electrically and physically coupling the lamp bulb to at least one dry cell battery;

wherein rotation of the head means for retaining the reflector and the lens in an axial direction away from the barrel causes movement of at least a portion of the coupling means which movement in turn causes movement of at least one dry cell battery to close an electrical circuit and turn the lamp bulb on.

6. A flashlight comprising:

a barrel for retaining a plurality of dry cell batteries;

a lamp bulb having a filament;

bulb holding means positioned adjacent one end of the barrel and adapted to locate the bulb filament axially beyond the one end of the barrel;

a substantially parabolic reflector;

a substantially planar lens;

means for retaining the reflector and the lens being engageable with the barrel at the end the bulb holding means is positioned and adapted to be controllably translatable along the barrel;

means for electrically coupling a center electrode of one of the batteries to a first electrode of the lamp bulb; and means for electrically coupling a case electrode of one of the batteries to a second electrode of the lamp bulb;

wherein relative motion of the head means for retaining the reflector and the lens in an axial direction away from the barrel closes an electrical contact of one of the coupling means and further relative motion in said same axial direction separates said means for retaining the reflector and the lens from the barrel to expose the lamp bulb and thereby permits dispersion of substantially spherical illumination.

7. A miniature flashlight comprising:

a lamp bulb;

a cylindrical aluminum barrel including a battery source of power disposed in a series arrangement within said barrel and having threads formed on an external surface of a first end of the barrel and threads formed on an internal surface of a second end of the barrel;

a head assembly including an aluminum head and an aluminum face cap which retain a substantially parabolic reflector and a substantially planar lens, the head assembly being rotatably disposed external to the first end of the barrel by threads formed on an interior surface of the head engaging with the threads formed on the external surface of the barrel;

a switch positioned radially within the circumference of the barrel and axially between the lamp bulb and the battery source of power, said switch being adapted to close in response to rotation of the head assembly in a direction away from the barrel to energize said lamp bulb and to open in response to rotation of the head assembly in a direction toward the barrel to de-energize said lamp bulb;

an aluminum tail cap adapted to retain a spare lamp bulb and having external threads which match and engage the threads at the second end of the barrel;

a metal spring disposed within the barrel so as to make electrical contact with the tail cap and a case electrode of the battery source of power and to urge the battery source of power in a direction toward said switch;

wherein rotational movement of the head assembly with respect to said barrel varies the relative positional relationship between the reflector and the lamp bulb when said lamp bulb is energized thereby providing an adjustable focus of light emission from the flashlight lens and also causes movement to the battery source of power along the longitudinal axis of the barrel when the lamp bulb is not energized.

8. A miniature flashlight comprising:

a lamp bulb;

a cylindrical aluminum barrel including a battery source of power disposed in a series arrangement within said barrel and having threads formed on an external surface of a first end of the barrel and threads formed on an internal surface of a second end of the barrel;

a head assembly including an aluminum head portion, a substantially parabolic reflector and a substantially planar lens, the head assembly being rotatably disposed external to the first end of the barrel by threads formed on an interior surface of the head engaging with the threads formed on the external surface of the barrel;

a switch positioned radially within the circumference of the barrel and axially between the lamp bulb and the battery source of power, said switch being adapted to close in response to rotation of the head assembly in a direction away from the barrel to energize said lamp bulb and to open in response to rotation of the head assembly in a direction toward the barrel to de-energize said lamp bulb;

an aluminum tail cap adapted to retain a spare lamp bulb and having external threads which match and engage the threads at the second end of the barrel;

a metal spring disposed within the barrel so as to make electrical contact with the tail cap and a case electrode of the battery source of power and to urge the battery source of power in a direction toward said switch;

wherein rotational movement of the head assembly with respect to said barrel varies the relative positional relationship between the reflector and the lamp bulb when said lamp bulb is energized thereby providing an adjustable focus of light emission from the flashlight lens and also causes movement of the battery source of power along the longitudinal axis of the barrel when the lamp is not energized.

9. A miniature flashlight comprising:

a lamp bulb;

a cylindrical metal barrel including a battery source of power disposed in a series arrangement within said barrel and having threads formed on an external surface of a first end of the barrel and threads formed on an internal surface of a second end of the barrel;

a head assembly including a metal head portion, a substantially parabolic reflector and a substantially planar lens, the head assembly being rotatably disposed external to the first end of the barrel by threads formed on an interior surface of the head engaging with the threads formed on the external surface of the barrel;

a switch positioned radially within the circumference of the barrel and axially between the lamp bulb and the battery source of power, said switch being adapted to close in response to rotation of the head assembly in a direction away from the barrel to energize said lamp bulb and to open in response to rotation of the head assembly in a direction toward the barrel to de-energize said lamp bulb;

a metal tail cap adapted to retain a spare lamp bulb and having external threads which match and engage the threads at the second end of the barrel;

a metal spring disposed within the barrel so as to make electrical contact with the tail cap and a case electrode of battery source of power and to urge the battery source of power in a direction toward said switch;

wherein rotational movement of the head assembly with respect to said barrel varies the relative positional relationship between the reflector and the lamp bulb when said lamp bulb is energized thereby providing an adjustable focus of light emission from the flashlight lens and also causes movement of the battery source of power along the longitudinal axis of the barrel when the lamp bulb is not energized.

10. A miniature flashlight comprising:

a lamp bulb;

a cylindrical barrel including a battery source of power disposed in a series arrangement within said barrel and having threads formed on an external surface of a first end of the barrel and threads formed on an internal surface of a second end of the barrel;

a head assembly including a head portion, a substantially parabolic reflector and a substantially planar lens, the head assembly being rotatably disposed external to the first end of the barrel;

a switch positioned radially within the circumference of the barrel and axially between the lamp bulb and the battery source of power, said switch being adapted to close in response to rotation of the head assembly in a direction away from the barrel to energize said lamp bulb and to open in response to rotation of the head assembly in a direction toward the barrel to de-energize said lamp bulb;

a tail cap adapted to retain a spare lamp bulb and having external threads which match and engage the threads at the second end of the barrel;

a metal spring disposed within the barrel so as to make electrical contact with the tail cap and a case electrode of battery source of power and to urge the battery source of power in a direction toward said switch;

wherein rotational movement of the head assembly with respect to said barrel varies the relative positional relationship between the reflector and the lamp bulb when said lamp bulb is energized thereby providing an adjustable focus of light emission from the flashlight lens and also causes movement of the battery source of power along the longitudinal axis of the barrel when the lamp bulb is not energized.

11. A miniature flashlight comprising a lamp bulb;

a cylindrical barrel including a battery source of power disposed in a series arrangement within said barrel and having threads formed on an external surface of a first end of the barrel and threads formed on an internal surface of a second end of the barrel;

a head assembly including a head portion, a substantially parabolic reflector and a substantially planar lens, the head assembly being rotatably disposed external to the first end of the barrel;

a switch positioned radially within the circumference of the barrel and axially between the lamp bulb and the battery source of power, said switch being adapted to close in response to rotation of the head assembly in a direction away from the barrel to energize said lamp bulb and to open in response to rotation of the head assembly in a direction toward the barrel to de-energize said lamp bulb;

a removable tail cap adapted to permit removal of the battery source of power from the second end of the barrel;

a metal spring disposed within the barrel so as to make electrical contact with the tail cap and a case electrode of battery source of power and to urge the battery source of power in a direction toward said switch;

wherein rotational movement of the head assembly with respect to said barrel varies the relative positional relationship between the reflector and the lamp bulb when said lamp bulb is energized thereby providing an adjustable focus of light emission from the flashlight lens and also causes movement of the battery source of power along the longitudinal axis of the barrel when the lamp bulb is not energized.

12. A miniature flashlight comprising:

a lamp bulb;

a cylindrical barrel including a battery source of power disposed in a series arrangement within said barrel and having threads formed on an external surface of a first end of the barrel and threads formed on an internal surface of a second end of the barrel;

a head assembly including a head portion, a substantially parabolic reflector and a substantially planar lens, the head assembly being rotatably disposed external to the first end of the barrel;

a switch positioned radially within the circumference of the barrel and axially between the lamp bulb and the battery source of power, said switch being adapted to close in response to rotation of the head assembly in a direction away from the barrel to energize said lamp bulb and to open in response to rotation of the head assembly in a direction toward the barrel to de-energize said lamp bulb;

a spring positioned to urge the battery source of power in a direction toward said switch;

wherein rotational movement of the head assembly with respect to said barrel varies the relative positional relationship between the reflector and the lamp bulb when said lamp bulb is energized thereby providing an adjustable focus of light emission from the flashlight lens and also causes movement of the battery source of power along the longitudinal axis of the barrel when the lamp bulb is not energized.

13. A miniature flashlight comprising:

a lamp bulb;

a cylindrical aluminum barrel including a battery source of power disposed in a series arrangement within said barrel and having threads formed on an external surface of a first end of the barrel and threads formed on an internal surface of a second end of the barrel;

a head assembly including a head portion, a substantially parabolic reflector and a substantially planar lens, the head assembly being rotatably disposed external to the first end of the barrel;

a switch positioned radially within the circumference of the barrel and axially between the lamp bulb and the battery source of power, said switch being adapted to close in response to rotation of the head assembly in a direction away from the barrel to energize said lamp bulb and to open in response to rotation of the head assembly in a direction toward the barrel to de-energize said lamp bulb;

a spring positioned to urge the battery source of power in a direction toward said switch;

wherein rotational movement of the head assembly with respect to said barrel opens and closes the switch by causing axial displacement of said battery source of power.

* * * * *